US008754330B2

(12) United States Patent
Takahashi et al.

(10) Patent No.: US 8,754,330 B2
(45) Date of Patent: Jun. 17, 2014

(54) ELECTRONIC CABLE

(75) Inventors: Kei Takahashi, Kanagawa (JP); Hirohisa Kubota, Saitama (JP); Tamotsu Tetsuchikawara, Kanagawa (JP)

(73) Assignees: Sony Corporation, Tokyo (JP); Sony Computer Entertainment Inc., Tokyo (JP)

( * ) Notice: Subject to any disclaimer, the term of this patent is extended or adjusted under 35 U.S.C. 154(b) by 31 days.

(21) Appl. No.: 13/485,995

(22) Filed: Jun. 1, 2012

(65) Prior Publication Data

US 2012/0305310 A1 Dec. 6, 2012

(30) Foreign Application Priority Data

Jun. 3, 2011 (JP) ..... 2011-125873

(51) Int. Cl.
*H01R 9/11* (2006.01)
*H01R 13/56* (2006.01)

(52) U.S. Cl.
USPC ..... 174/74 R; 174/72 A; 174/75 R; 174/68.1; 138/118

(58) Field of Classification Search
USPC ..... 174/74 R, 72 A, 75 R, 77 R, 79, 82, 85, 174/110 R, 84 R, 84 C, 107, 68.1, 69, 113 R, 174/88 R; 138/118, 121, 122, 123, 124, 125, 138/126, 129, 137; 439/607.01, 607.41, 439/660, 417, 449, 474
See application file for complete search history.

(56) References Cited

U.S. PATENT DOCUMENTS

| | | | | |
|---|---|---|---|---|
| 5,941,733 | A * | 8/1999 | Lai | 439/607.01 |
| 6,716,056 | B1 * | 4/2004 | Hsu | 439/417 |
| 6,902,432 | B2 * | 6/2005 | Morikawa et al. | 439/607.41 |
| 7,618,293 | B2 * | 11/2009 | Wu | 439/660 |
| 7,960,652 | B2 * | 6/2011 | Drew et al. | 174/74 R |
| 8,303,337 | B2 * | 11/2012 | Ballard et al. | 174/113 R |
| 2007/0202956 | A1 | 8/2007 | Ogasawara | |
| 2010/0243293 | A1 | 9/2010 | Tanaka | |

FOREIGN PATENT DOCUMENTS

| | | | |
|---|---|---|---|
| CN | 101843182 | A | 9/2010 |
| JP | 58095512 | U | 6/1983 |

(Continued)

OTHER PUBLICATIONS

Office Action for corresponding Japanese Patent Application No. 2011-125873, dated May 7, 2013.

(Continued)

*Primary Examiner* — Angel R Estrada
(74) *Attorney, Agent, or Firm* — Matthew B. Dernier, Esq.; Gibson & Dernier LLP

(57) ABSTRACT

A cable main includes an outer tube, a core wire, and an assisting wire. The assisting wire is less stretchable than the outer tube. Connectors provided at ends of the cable main fasten ends of the assisting wire at ends of the outer tube so as to restrain the ends of the outer tube from moving in a stretch direction of the outer tube. According to this structure, even when the outer tube is stretched, a load applied to a connecting part between the core wire and a terminal of the connector can be reduced.

4 Claims, 6 Drawing Sheets

(56) References Cited

FOREIGN PATENT DOCUMENTS

| | | | |
|---|---|---|---|
| JP | 2006286229 | A | 10/2006 |
| JP | 2006302790 | A | 11/2006 |
| JP | 2009054510 | A | 3/2009 |
| JP | 2009099300 | A | 5/2009 |
| JP | 2010182632 | A | 8/2010 |
| WO | 2009057546 | A1 | 5/2009 |

OTHER PUBLICATIONS

Office Action for corresponding Chinese Patent Application No. 201210180901.4, dated Mar. 5, 2014.

* cited by examiner

FIG.6
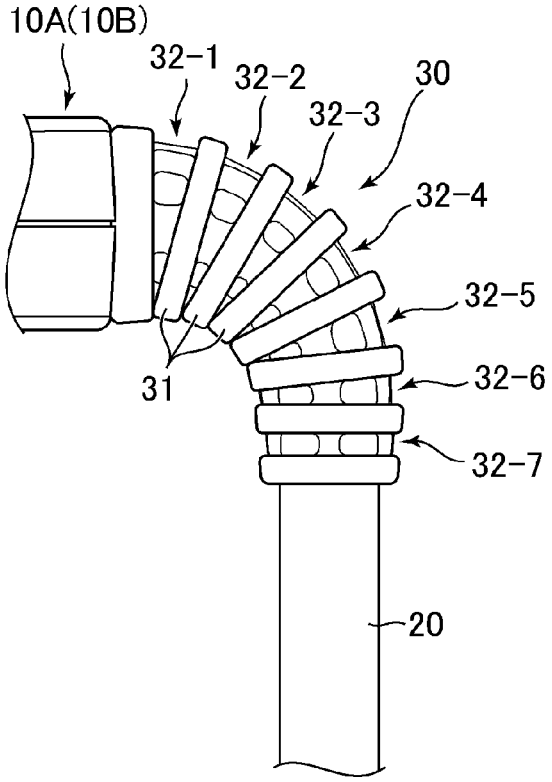
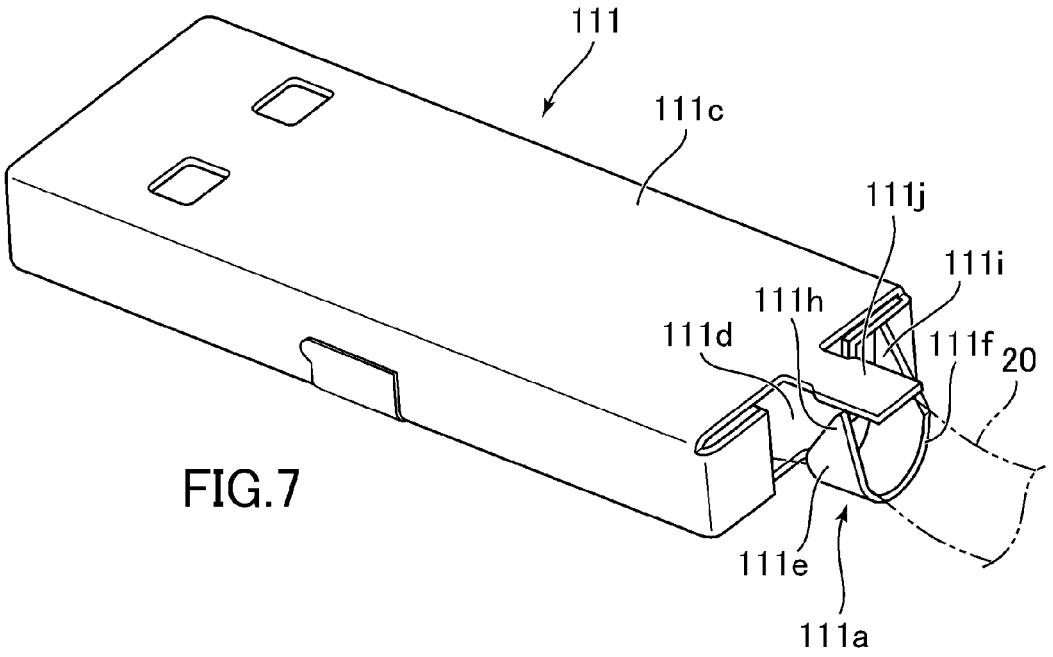
FIG.7

ELECTRONIC CABLE

CROSS-REFERENCE TO RELATED APPLICATION

The present application claims priority from Japanese application JP 2011-125873 filed on Jun. 3, 2011 the content of which is hereby incorporated by reference into this application.

BACKGROUND OF THE INVENTION

1. Field of the Invention

The present invention relates to an electronic cable used for electrical connection between electronic devices.

2. Description of the Related Art

Conventionally, an electronic cable for electrically connecting two electronic devices is used. For example, a portable electronic device disclosed in U.S. Patent Application Publication No. 2007/0202956 has a USB terminal and is connected to another electronic device via a USB cable.

The electronic cable includes a cable main having plural core wires and an outer tube covering the core wires, and a connector provided at an end of the cable main. The connector has a metallic case, and the end of the cable main is inserted in the case. Ends of the core wires extend further from an end of the outer tube and are soldered to terminals housed in the case.

SUMMARY OF THE INVENTION

The outer tube is made of a flexible and stretchable resin. Therefore, the outer tube may stretch when the cable main is bent or stretched in the length direction thereof. However, since the core wires made of a conductor such as copper do not stretch, a load is applied to the connecting part between the core wires and the terminals when the outer tube stretches.

An electronic cable according to an aspect of the invention includes a cable main and connectors provided at both ends of the cable main. The cable main includes an outer tube that is stretchable in a length direction thereof, a core wire that is laid through the inside of the outer tube and has both ends thereof connected respectively to terminals provided in the connectors, and an assisting wire that is laid through the inside of the outer tube and is less stretchable than the outer tube. The connectors fasten the both ends of the assisting wire respectively to the both ends of the outer tube so as to restrain movement of the both ends of the outer tube in a stretch direction of the outer tube.

According to the electronic cable, stretching of the outer tube can be restrained even when the cable main is bent or stretched in the length direction thereof. Therefore, a load applied to the connecting part between the ends of the core wire and the terminals can be reduced.

BRIEF DESCRIPTION OF THE DRAWINGS

FIG. 6 is a side view showing the state of the bushing when the electronic cable is bent.

FIG. 7 shows a modification of the shield case provided on the connector.

DETAILED DESCRIPTION OF THE PREFERRED EMBODIMENTS

Figure 1:
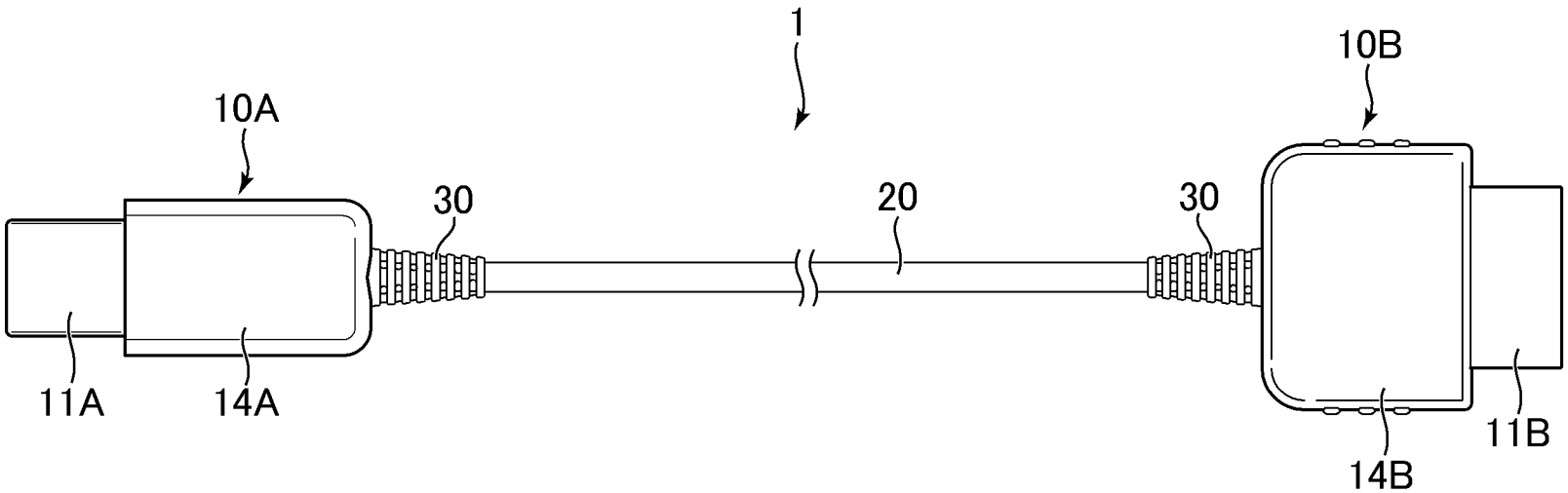
FIG. 1 is a plan view of an electronic cable according to an embodiment of the invention.
Figure 2:
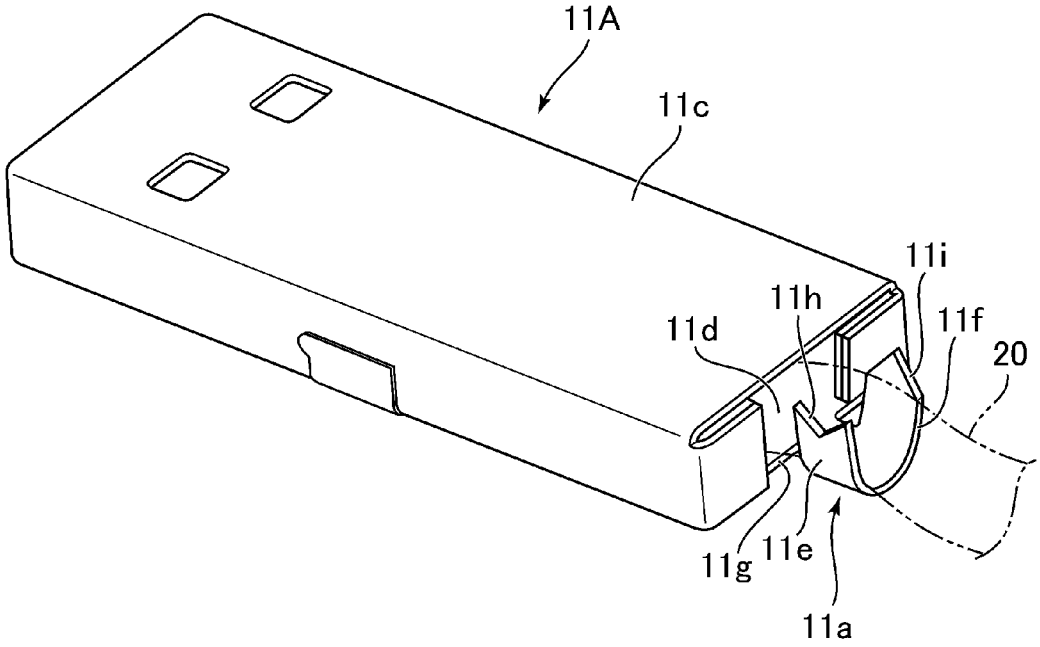
FIG. 2 is a perspective view of a shield case provided on a connector of the electronic cable.
Figure 3:
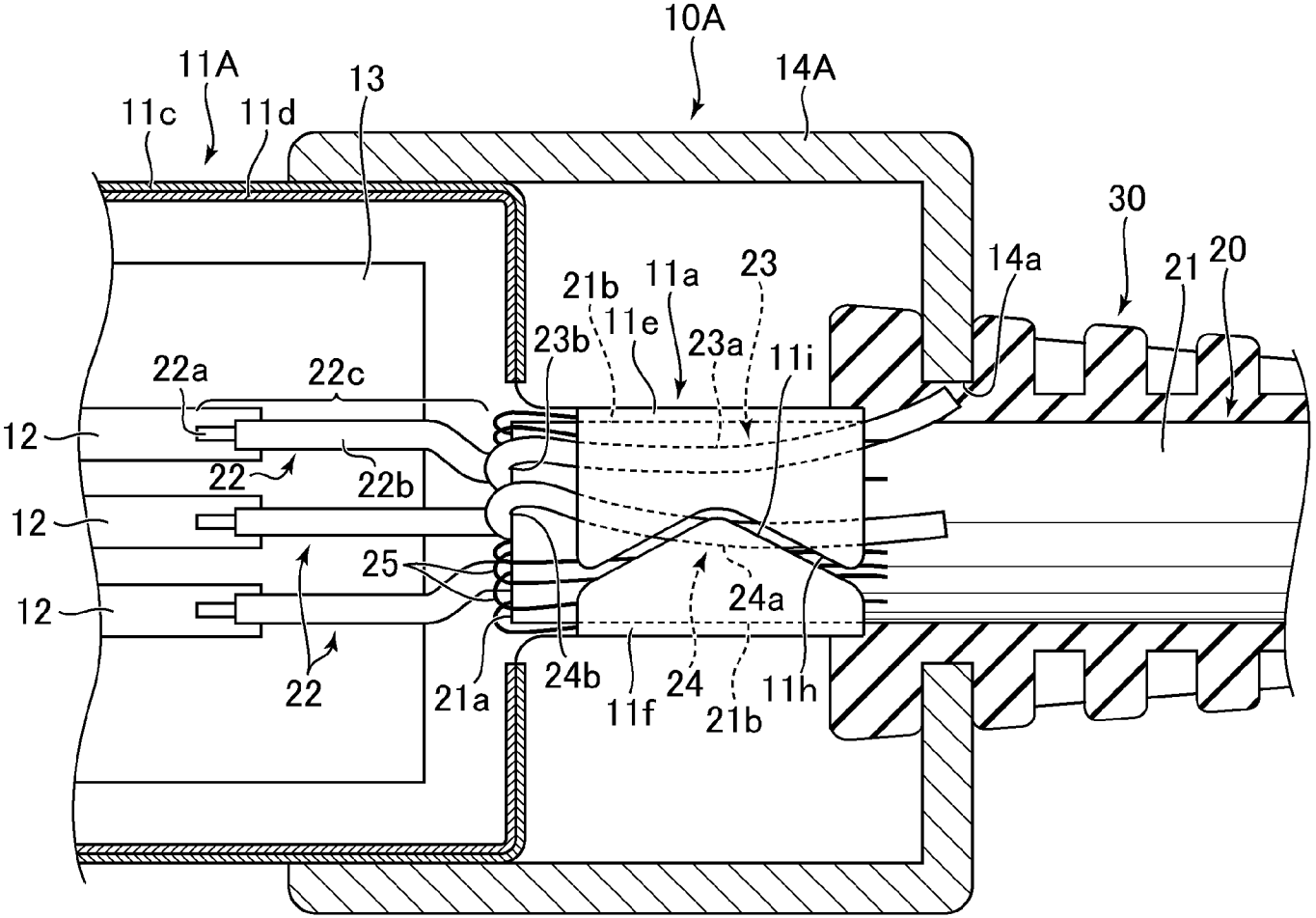
FIG. 3 is a horizontal sectional view of the connector.

Hereinafter, an embodiment of the invention will be described with reference to the drawings. FIG. 1 is a plan view of an electronic cable 1 according to an embodiment of the invention. FIG. 2 is a perspective view of a shield case 11A provided on a connector 10A provided at an end of the cable 1. FIG. 3 is a horizontal sectional view of the connector 10A.

The electronic cable 1 is used for electrically connecting two electronic devices, for example, a USB cable, HDMI cable, DVI cable, Centronics cable or the like. As shown in FIG. 1, the cable 1 includes a cable main 20 and connectors 10A, 10B provided at both ends thereof. The connectors 10A, 10B are plug connectors inserted into receptacle connectors provided on electronic devices when the cable 1 is used. Although the connectors 10A, 10B in this example have different sizes from each other, these connectors may have the same size. As described later, the connectors 10A, 10B have a function of reducing a load applied to the connecting parts between terminals 12 provided in the connectors 10A, 10B and core wires 22 of the cable main 20. The structures described below are common to the connectors 10A, 10B.

As shown in FIG. 2 and FIG. 3, the connector 10A has a metallic shield case 11A. Plural terminals 12 are housed in the shield case 11A. When the connector 10A is inserted in a receptacle connector, the terminals 12 contact terminals of the receptacle connector. In this example, a plate-like base 13 is housed in the shield case 11A and the terminals 12 are mounted on the base 13. As shown in FIG. 1, the connector 10B, too, has a metallic shield case 11B. Plural terminals 12 and a base 13 are housed also in the shield case 11B.

As shown in FIG. 1, the connectors 10A, 10B have resin cases 14A, 14B covering outer surfaces of rear parts (parts toward the center of the cable 1) of the shield cases 11A, 11B. Inside the resin cases 14A, 14B, a holding portion 11*a*, described later, and an end of the cable main 20 are arranged. In the example shown in FIG. 3, a space is formed in the resin case 14A, and the holding portion 11*a* and the end of the cable main 20 are arranged in this space. However, such a space may not be formed in the resin case 14A. That is, the inside of the resin case 14A may be filled with the resin which forms the case 14A.

The cable main 20 extends toward the inside of the case 14A, 14B from an opening 14*a* formed in a rear part of the resin case 14A, 14B (see FIG. 3). The connector 10A, 10B has a bushing 30. The bushing 30 extends to the rear side, that is, toward the center of the cable 1, from the case 14A, 14B. In the example of FIG. 3, the bushing 30 and the resin case 14A are separate members. However, these members may be molded as a unitary member.

The cable main 20 has an outer tube 21, as shown in FIG. 3. The outer tube 21 is made of a material that is stretchable (elastic) in the length direction of the cable main 20. The outer tube 21 is made of, for example, a resin such as fluorine-containing resin, polyvinyl chloride or polyethylene, or an elastomer, and has flexibility and stretchability (elasticity) in the length direction thereof.

The cable main 20 also has the plural core wires 22 which are made of a conductor and laid through the inside of the outer tube 21. In FIG. 3, three core wires 22 are shown. However, the number of the core wires 22 may be properly changed according to the standard of the cable 1. The core wire 22 has a conductor wire 22*a* made of a conductor such as copper and an insulating tube 22*b* covering the conductor wire 22*a*. The core wire 22 has, at both ends thereof, a core wire end 22*c* extending further from the end of the outer tube 21. The core wire end 22*c* extends into the shield case 11A, 11B from an opening formed on a rear surface of the shield case 11A, 11B and is connected to the terminal 12, as shown in FIG. 3. That is, the end of the conductor wire 22*a* is soldered to the terminal 12.

The cable main 20 includes an assisting wire that is laid through the inside of the outer tube 21, as shown in FIG. 3. The cable main 20 in this example includes two assisting wires 23, 24. The assisting wires 23, 24 extend straight along the outer tube 21 within the outer tube 21, without being wound around the core wires 22 or twisted within the outer tube 21. That is, when the outer tube 21 is arranged linearly, the assisting wires 23, 24 extend linearly within the outer tube 21. The assisting wires 23, 24 are made of a material that is less stretchable than the outer tube 21. The connectors 10A, 10B fasten both ends of the assisting wires 23, 24 respectively at both ends 21*b* of the outer tube 21 so as to restrain movement of the both ends of the outer tube 21 in the stretch direction (that is the length direction) of the outer tube 21.

In this example, each of the both ends of the assisting wires 23 is hooked on the end 21*b* of the outer tube 21 so as to restrain the movement of the end 21*b* of the outer tube 21 in the stretch direction of the outer tube 21, as shown in FIG. 3. Similarly to that, each of the both ends of the assisting wires 24 is hooked on the end 21*b* of the outer tube 21. Specifically, the assisting wires 23, 24 have, at both ends thereof, folded portions 23*a*, 24*a* protruding further from the outer tube 21 and folded toward the outer surface of the outer tube 21. Bent portions 23*b*, 24*b* situated at proximal parts of the folded portions 23*a*, 24*a* are hooked on an end surface 21*a* of the outer tube 21. The connector 10A, 10B has the holding portion 11*a* which holds the folded portions 23*a*, 24*a* and the outer tube 21 (see FIG. 2). By this holding portion 11*a*, the ends of the assisting wires 23, 24, that is, the folded portions 23*a*, 24*a*, are fastened to the both ends 21*b* of the outer tube 21 and kept hooked thereon.

According to the cable 1 of this structure, the outer tube 21 is restrained from stretching by the assisting wires 23, 24. Consequently, even when the cable main 20 is bent or stretched in the length direction, a load is prevented from being applied to the connecting part between the core wires 22 and the terminals 12, that is, the soldered portion between the ends of the conductor wires 22*a* and the terminals 12. Specifically, the base 13 with the terminals 12 mounted thereon is connected to the outer surface of the outer tube 21 through the shield case 11A, 11B, the resin case 14A, 14B and the bushing 30. Therefore, in a structure without having the assisting wires 23, 24, when the outer tube 21 stretches, the position of the terminals 12 shifts in relation to the ends of the conductor wires 22*a* and consequently a load is applied to the connecting part between the ends of the conductor wires 22*a* and the terminals 12. According to the cable 1 having the assisting wires 23, 24, such generation of a load can be restrained.

The assisting wires 23, 24 are made of different materials from each other and have different temperature characteristics, electrical properties and bending strengths. Therefore, the outer tube 21 can be restrained from stretching securely irrespective of the environment where the cable 1 is used. In this example, the assisting wire 24 is a metal (for example, copper) wire. The assisting wire 23 is a resin thread. The outer surface of the assisting wire 23 is more flexible than the metal wire. Therefore, the folded portion 23*a* of the assisting wire 23 can be prevented from slipping on the holding portion 11*a*. Particularly in this example, the assisting wire 23 is a nylon or Kevlar (trademark registered) thread and has a high tensile strength. Thus, the assisting wire 23 can be prevented from snapping halfway. The assisting wire 23 may also be made of cotton.

The cable main 20 has plural shield wires 25 inside the outer tube 21. The shield wires 25 are intertwined within the outer tube 21 and cover the core wires 22 and the assisting wires 23, 24. As shown in FIG. 3, the ends of the shield wires 25 protrude from the outer tube 21 and are folded toward the outer surface of the outer tube 21. The ends of the shield wires 25 are held together with the assisting wires 23, 24 by the holding portion 11*a*. The assisting wire 24 is a thicker conductor wire than the shield wire 25.

As described above, the connector 10A, 10B has the metallic shield case 11A, 11B. The holding portion 11*a* is formed integrally with the shield case 11A, 11B. Referring to FIG. 2 and FIG. 3, the shield case 11A includes an upper case 11*c* in a shape of box opening downward, and a lower case 11*d* in a shape of box opening upward. These two cases 11*c*, 11*d* are combined in an up-and-down direction, thus forming the shield case 11A. The case 11*c*, 11*d* is a member made of a single metal plate formed by press working or the like. The holding portion 11*a* is formed integrally with the lower case 11*d*. That is, in the press working to form the case 11*d*, the holding portion 11*a* is formed together with the case 11*d*. Also in the shield case 11B, as in the shield case 11A, the holding portion 11*a* is formed integrally with the shield case 11B.

The holding portion 11*a* is substantially U-shaped. That is, the holding portion 11*a* includes a pair of plate portions 11*e*, 11*f* connected to each other at bottom parts thereof, as shown in FIG. 2. The end of the cable main 20 is arranged between the plate portions 11*e*, 11*f*. The plate portions 11*e*, 11*f* are bent inward so as to contact the outer surface of the outer tube 21 tightly. That is, the plate portions 11*e*, 11*f* are caulked. In FIG. 2, the plate portions 11*e*, 11*f* before being bent inward are shown. The bottom parts of the two plate portions 11*e*, 11*f* are connected to a rear edge 11*g* of the lower case 11*d*.

As shown in FIG. 3, the end of the plate portion 11*e* and the end of the plate portion 11*f* are formed to cross with each other in the length direction (extension direction) of the cable main 20. In this example, the plate portion 11*e* has a recessed cross portion 11*h* at the end thereof. The plate portion 11*f* has a protruding cross portion 11*i* at the end thereof. With the plate portions 11*e*, 11*f* bent inward, the cross portion 11*i* fits inside the cross portion 11*h*, as shown in FIG. 3. Meanwhile, the folded portions 23*a*, 24*a* of the assisting wires 23, 24 are arranged to extend roughly in the length direction of the cable main 20. Therefore, the folded portions 23*a*, 24*a* can be prevented from being removing through the gap between the plate portion 11*e* and the plate portion 11*f*.

As described above, the assisting wire 24 is a conductor wire. The folded portion 24*a* of the assisting wire 24 and the ends of the shielded wires 25 are sandwiched between the holding portion 11*a* and the outer surface of the outer tube 21. Thus, the assisting wire 24 and the shield wires 25 are electrically connected to the shield case 11A, 11B. In this structure, the assisting wire 24 can also be used as a ground wire.

Figure 4:
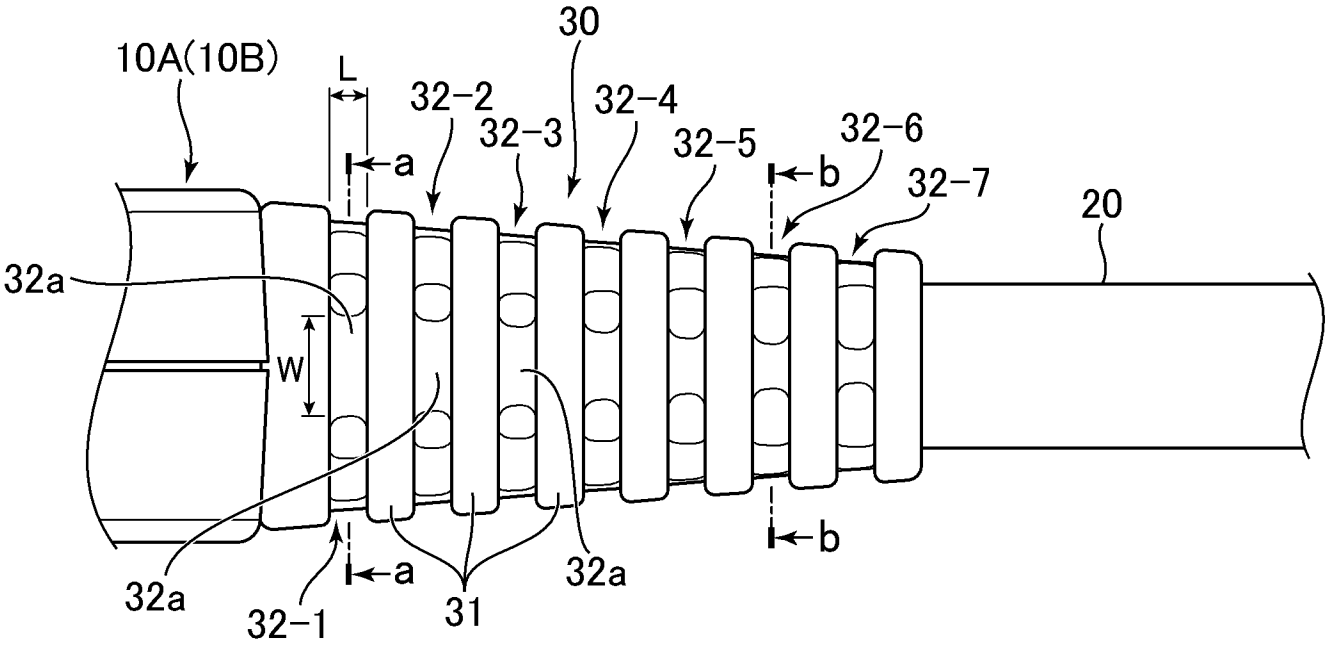
FIG. 4 is a side view of a bushing provided on the electronic cable.
Figure 5A:
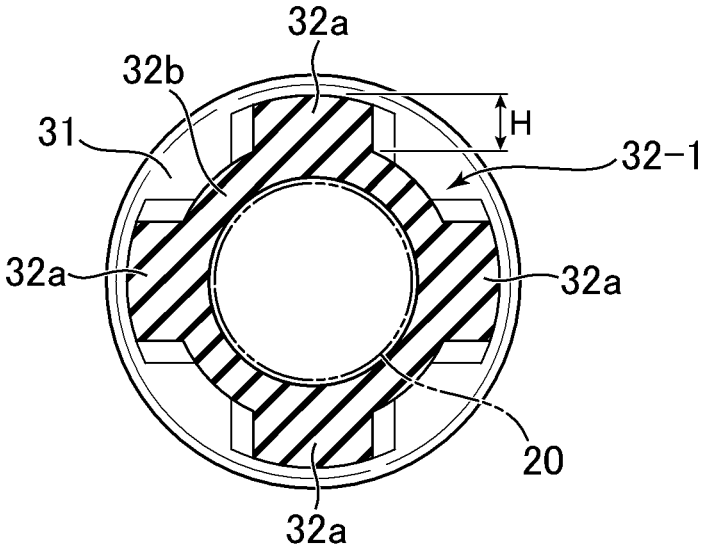
FIG. 5A and FIG. 5B are sectional views of the bushing.
Figure 5B:
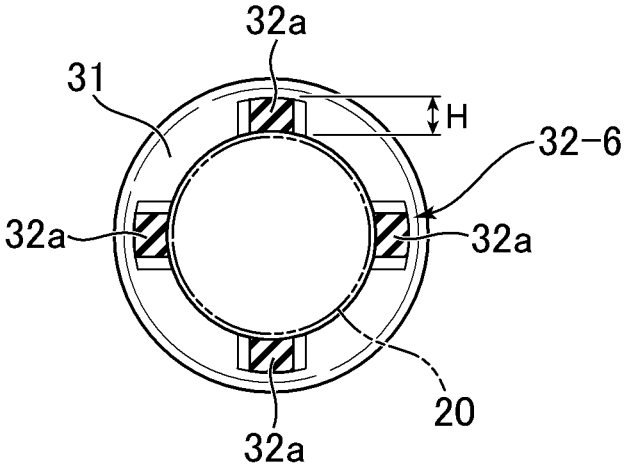

As described above, the cable 1 has the bushing 30. FIG. 4 is a side view of the bushing 30. FIG. 5A and FIG. 5B are sectional views of the bushing 30. FIG. 5A is a sectional view as viewed along line a-a in FIG. 4. FIG. 5B is a sectional view as viewed along line b-b in FIG. 4. FIG. 6 is a side view showing the state of the bushing 30 when the cable main 20 is bent in relation to the connector 10A, 10B.

As described above, the bushing 30 extends from the rear side of the resin case 14A, 14B of the connector 10A, 10B, and the cable main 20 is laid through the inside of the bushing 30. The bushing 30 is made of a flexible and elastic resin (for example, rubber) and restrains the application of an excessive load to the connecting part between the cable main 20 and the connector 10A, 10B when the cable main 20 is bent in relation to the connector 10A, 10B.

As shown in FIG. 4, the bushing 30 has plural ring portions 31 arrayed in the length direction of the cable main 20. The bushing 30 also has plural intermediate portions 32-1 to 32-7 formed between two neighboring ring portions 31. The intermediate portions 32-1 to 32-7 and the ring portions 31 are formed alternately and these portions as a whole become gradually narrower toward the rear side (that is, toward the center of the cable 1). The width L of the intermediate portions 32-1 to 32-7 in the direction of the length of the cable main 20 is approximately equal.

As shown in FIG. 5A and FIG. 5B, each intermediate portion 32-1 to 32-7 includes plural protrusions 32*a* arrayed at certain intervals in the circumferential direction of the cable main 20. In this example, each intermediate portion 32-1 to 32-7 has four protrusions 32*a*. A recessed portion is formed between two neighboring protrusions 32*a* in the circumferential direction. As shown in FIG. 6, when the cable main 20 is bent in relation to the connector 10A, 10B, the protrusions 32*a* situated on the outer side stretch in the bending direction and the protrusions 32*a* situated on the inner side shrink in the bending direction. Consequently, the bushing 30 becomes arcuate. Depending on the bending angle, the two neighboring ring portions 31 contact each other at inner-side portions thereof.

In the bushing 30 in this example, each intermediate portion 32-1 to 32-7 is formed such that the stretch amounts of the protrusions 32*a* which stretch when the cable main 20 is bent is equal among the plural intermediate portions 32-1 to 32-7. Specifically, the height H of the protrusion 32*a* in the radial direction of the cable main 20 (see FIG. 5A and FIG. 5B), and the width W of the protrusion 32*a* in the circumferential direction of the cable main 20 (see FIG. 4) are set so that the stretch amounts of the protrusions 32*a* are equal among the plural intermediate portions 32-1 to 32-7. Also, in this example, an annular bottom portion 32*b* is formed in the plural (in this example, two) intermediate portions 32-1, 32-2 which are close to the connector 10A, 10B. In the intermediate portion 32-1, 32-2, the protrusions 32*a* protrude radially from the bottom portion 32*b*. The thickness of the bottom portion 32*b* in the radial direction of the cable main 20, too, is set such that the stretch amount of the protrusion 32*a* is equal among the plural intermediate portions 32-1 to 32-7. Such a bushing 30 shows a gentle arc when the cable main 20 is bent. On the other intermediate portions 32-3 to 32-7, the bottom portion 32*b* is not formed and the outer surface of the outer tube 21 is exposed between the two neighboring protrusions 32*a* in the circumferential direction.

As described above, the cable main 20 includes the assisting wires 23, 24 that are less stretchable than the outer tube 21. The connectors 10A, 10B fasten the ends of the assisting wires 23, 24 to the ends 21*b* of the outer tube 21 so as to restrain movement of the ends 21*b* of the outer tube 21 in the stretch direction of the outer tube 21. According to such a cable 1, even when the cable main 21 is bent or stretched in the direction of the length thereof, the outer tube 21 can be restrained from stretching and thus the load applied to the connecting part between the ends of the core wires 22 and the terminals 12 can be reduced.

The folded portions 23*a*, 24*a* of the assisting wires 23, 24 protrude from both ends of the outer tube 21 and are folded toward the outer surface of the outer tube 21. The holding portion 11*a* holds the outer tube 21 and the folded portions 23*a*, 24*a* of the assisting wires 23, 24. According to this structure, the hooked state between the ends of the assisting wires 23, 24 and the end of the outer tube 21 can be securely prevented from being broken off.

The connector 10A, 10B has the shield case 11A, 11B housing the terminals 12. The holding portion 11*a* is formed integrally with the shield case 11A, 11B. According to this structure the number of components of the connectors 10A, 10B can be reduced.

The assisting wire 23 is made of a resin. Accordingly, the folded portion 23*a* of the assisting wire 23 can be prevented from slipping from the holding portion 11*a*.

The cable main 20 includes the assisting wire 23 and the assisting wire 24 which are made of different materials from each other. According to this structure, the outer tube 21 can be restrained from stretching securely irrespective of the environment where the cable 1 is used.

The assisting wire 23 is made of a resin and the assisting wire 24 is made of a metal. Therefore, temperature characteristics and electrical properties of the assisting wire 23 and the assisting wire 24 can easily be made different from each other.

The connector 10A, 10B has the metallic shield case 11A, 11B housing the terminals 12. The holding portion 11*a* of the shield case 11A, 11B holds the assisting wire 24 made of a conductor and the outer tube 21. The assisting wire 24 is electrically connected with the shield case 11A, 11B. According to this structure, the assisting wire 24 can function as a ground wire.

The invention is not limited to the above-described cable 1 and various changes can be made.

For example, in the above description, the cable 1 has the two assisting wires 23, 24. However, the cable 1 may be provided with one of the assisting wires. Alternatively, the cable 1 may be provided with more assisting wires.

The shape of the holding portion 11*a* is not limited to the above-described example. For example, the holding portion of the cable 1 may be shaped as shown in FIG. 7. That is, a holding portion 111*a* provided on a shield case 111 shown in FIG. 7 is substantially U-shaped and has a pair of plate portions 111*e*, 111*f* connected at a bottom portion. The plate portions 111*e*, 111*f* have cross portions 111*h*, 111*i* at the ends thereof. The cross portions 111*h*, 111*i* are substantially triangular and formed with a width gradually decreasing toward the distal end. Particularly in this example, the plate portions 111*e*, 111*i* are bent inward and the boundary between the cross portions 111*h*, 111*i* is slant in relation to the length direction of the cable main 20. Therefore, the cross portions 111*h*, 111*i* cross with each other in the length direction of the cable main 20. Thus, the folded portions 23*a*, 24*a* of the assisting wires 23, 24 can be prevented from being removed off through the boundary of the cross portions 111*h*, 111*i*.

An upper case 111*c* of the shield case 111 shown in FIG. 7 has an auxiliary plate portion 111*j*. The auxiliary plate portion 111*j* is formed extending to the rear side from the rear edge of the upper case 111*c*. The plate portions 111*e*, 111*f* are bent inward so that the auxiliary plate portion 111*j* is situated within these plate portions. The folded portions 23*a*, 24*a* of the assisting wires 23, 24 are sandwiched between the auxiliary plate portion 111*j* and the outer surface of the outer tube 21. According to such a structure, a force to hold the folded portions 23*a*, 24*a* and the outer tube 21 is applied not only from the plate portions 111*e*, 111*f* but also from the auxiliary plate portion 111*j*. Therefore, the strength of holding the folded portions 23*a*, 24*a* can be increased. Thus, the strength of electrical connection between the upper case 111*c* and a lower case 111*d* and the assisting wire 24 can be increased.

What is claimed is:

1. An electronic cable comprising:

a cable main including:

an outer tube stretchable in a length direction of the cable main, a plurality of core wires laid through an inside of the outer tube, each of the core wires including a conductor wire and an insulating tube covering the conductor wire, and an assisting wire laid through the inside of the outer tube and being less stretchable than the outer tube, the assisting wire including a respective folded portion at each end thereof, the folded portion protruding further from the outer tube and being folded toward an outer surface of the outer tube, and connectors provided at both ends of the cable main, each of the connectors including:

terminals electrically connected to respective ends of the conductor wires of the core wires, a shield case made of metal and housing the terminals, a holding portion formed in the shield case, the folded portion of the assisting wire being held between the holding portion and the outer surface of the outer tube, and a resin case connected to the outer tube and the shield case, and covering the holding portion.

2. The electronic cable according to claim 1, wherein the holding portion is formed integrally with the shield case.

3. The electronic cable according to claim 1, comprising a first assisting wire, which is the assisting wire made of resin, and a second assisting wire which is made of different materials than the first assisting wire.

4. The electronic cable according to claim 3, wherein the second assisting wire is made of a metal.

* * * * *